United States Patent [19]

Thöne et al.

[11] Patent Number: 4,516,622

[45] Date of Patent: May 14, 1985

[54] PLATE MOULD OF A CONTINUOUS CASTING PLANT

[75] Inventors: Heinrich Thöne, Stiedelsbach; Reinhard Hargassner, Linz; Gottfried Deibl, Luftenberg; Günter Holleis, Linz, all of Austria

[73] Assignee: Voest-Alpine Aktiengesellschaft, Linz, Austria

[21] Appl. No.: 404,502

[22] Filed: Aug. 2, 1982

[30] Foreign Application Priority Data

Aug. 21, 1981 [AT] Austria ..... 3658/81
May 25, 1982 [AT] Austria ..... 2052/82

[51] Int. Cl.[3] ..... B22D 11/04; B22D 11/00

[52] U.S. Cl. ..... 164/416; 164/418; 164/436

[58] Field of Search ..... 164/418, 436, 491, 478, 164/416

[56] References Cited

U.S. PATENT DOCUMENTS

| | | | |
|---|---|---|---|
| 3,292,216 | 12/1966 | Colombo | 164/435 |
| 3,583,473 | 6/1971 | Strohschein et al. | 164/436 |
| 3,926,244 | 12/1975 | Meier et al. | 164/455 |
| 4,085,793 | 4/1978 | Scheinecker et al. | 164/436 |

FOREIGN PATENT DOCUMENTS

| | | | |
|---|---|---|---|
| 0032487 | 7/1981 | European Pat. Off. . | |
| 1254828 | 11/1967 | Fed. Rep. of Germany . | |
| 2415224 | 10/1974 | Fed. Rep. of Germany . | |
| 2500395 | 7/1975 | Fed. Rep. of Germany . | |
| 2620751 | 11/1977 | Fed. Rep. of Germany . | |
| 2426515 | 1/1980 | France | 164/436 |
| 47-32179 | 8/1972 | Japan | 164/416 |
| 544598 | 1/1974 | Switzerland . | |

*Primary Examiner*—Kuang Y. Lin
*Assistant Examiner*—Richard K. Seidel
*Attorney, Agent, or Firm*—Brumbaugh, Graves, Donohue & Raymond

[57] ABSTRACT

A plate mould of a continuous casting plant includes a carrying frame mounted on a reciprocating mould lifting table, and walls supported on the carrying frame and delimiting the mould cavity. At least one of the side walls is displaceable transversely to the mould axis by an adjustment drive to change the format of the strand cross section. In order to reduce the expenditures in terms of machinery and investments for a continuous casting plant, the adjustment drive is arranged on a stationary supporting structure neighboring the lifting table, or on the lifting table, and is in connection with the adjustable side wall via a coupling.

16 Claims, 10 Drawing Figures

PLATE MOULD OF A CONTINUOUS CASTING PLANT

BACKGROUND OF THE INVENTION

The invention relates to a plate mould of a continuous casting plant, in particular for continuously casting steel slabs, comprising a carrying frame mounted on a reciprocating mould lifting table, and walls supported on the carrying frame and delimiting the mould cavity, at least one of the mould walls being displaceable transversely to the mould axis by means of an adjustment drive, in particular driving an adjustment gear to change the format of the strand cross section.

With plate moulds of this kind (U.S. Pat. No. 3,292,216 and U.S. Pat. No. 3,926,244) an adjustment means mostly comprised of an adjustment gear and an adjustment drive is arranged on the carrying frame for the purpose of changing the format.

Since in a continuous casting plant several carrying frames with mould walls inserted therein must always be available in order not to have to carry out repair or maintenance work at a mould installed in the plant in case of a failure, but to be able to exchange the carrying frame with its mould walls for another intact mould with its mould walls in a time-saving manner, it is necessary with conventional moulds to provide adjustment drives for each carrying frame to displace the at least one displaceable mould wall of each carrying frame. The lifting table forming part of the mould remains in the continuous casting plant in case of an exchange of the carrying frame supporting the mould walls.

The invention aims at avoiding this disadvantage and has as its object to provide a plate mould of the initially defined kind whose use requires considerably less expenditures in terms of machinery and investments for a continuous casting plant than with the use of known plate moulds.

SUMMARY OF THE INVENTION

This object is achieved according to the invention in that the adjustment drive is arranged on a stationary supporting structure neighboring the lifting table or on the lifting table, being in connection with the at least one adjustable mould wall via a coupling. By arranging the adjustment drive on the supporting structure or on the lifting table, the adjustment drive is utilizable for all the carrying frames, i.e., the mould installed in the plant as well as the carrying frames ready for exchange (after insertion of the same into the plant), so that a continuous casting plant equipped with the plate mould of the invention requires substantially less investment expenditures.

According to a preferred embodiment, the coupling is provided between an adjustment gear arranged on the carrying frame and the adjustment drive arranged on the stationary supporting structure.

It is of advantage if, according to another embodiment, the coupling is arranged between the at least one adjustable mould wall and an adjustment gear arranged on the lifting table, whereby not only the adjustment drive, but also the adjustment gear may be utilized for all the carrying frames used in a continuous casting plant.

Preferably, a clutch coupling is provided as the coupling, in particular a coupling allowing for angular excursions, such as a jaw clutch coupling.

According to a further preferred embodiment the driving shaft, which is turnable on and off by the coupling, is designed as an articulation shaft.

In order to enable the utilization of end walls of different widths for the mould, the shaft connecting the adjustment drive with the adjustment gear, according to a preferred embodiment, is adjustable in length.

According to another embodiment in which the adjustment gear is also arranged on the lifting table, the adjustment drive and the adjustment gear advantageously are displaceably mounted on the lifting table for the adjustment of different strand thicknesses.

BRIEF DESCRIPTION OF THE DRAWINGS

The invention will now be explained in more detail, by way of three embodiments illustrating, for example, its use with moulds for casting slabs having rectangular cross sections, with reference to the accompanying schematic drawings, FIGS. 1 to 3 illustrating a first embodiment, FIGS. 4 to 8 illustrating a second embodiment, and FIGS. 9 and 10 illustrating a third embodiment, wherein.

DESCRIPTION OF EXAMPLARY EMBODIMENTS

Figure 1:
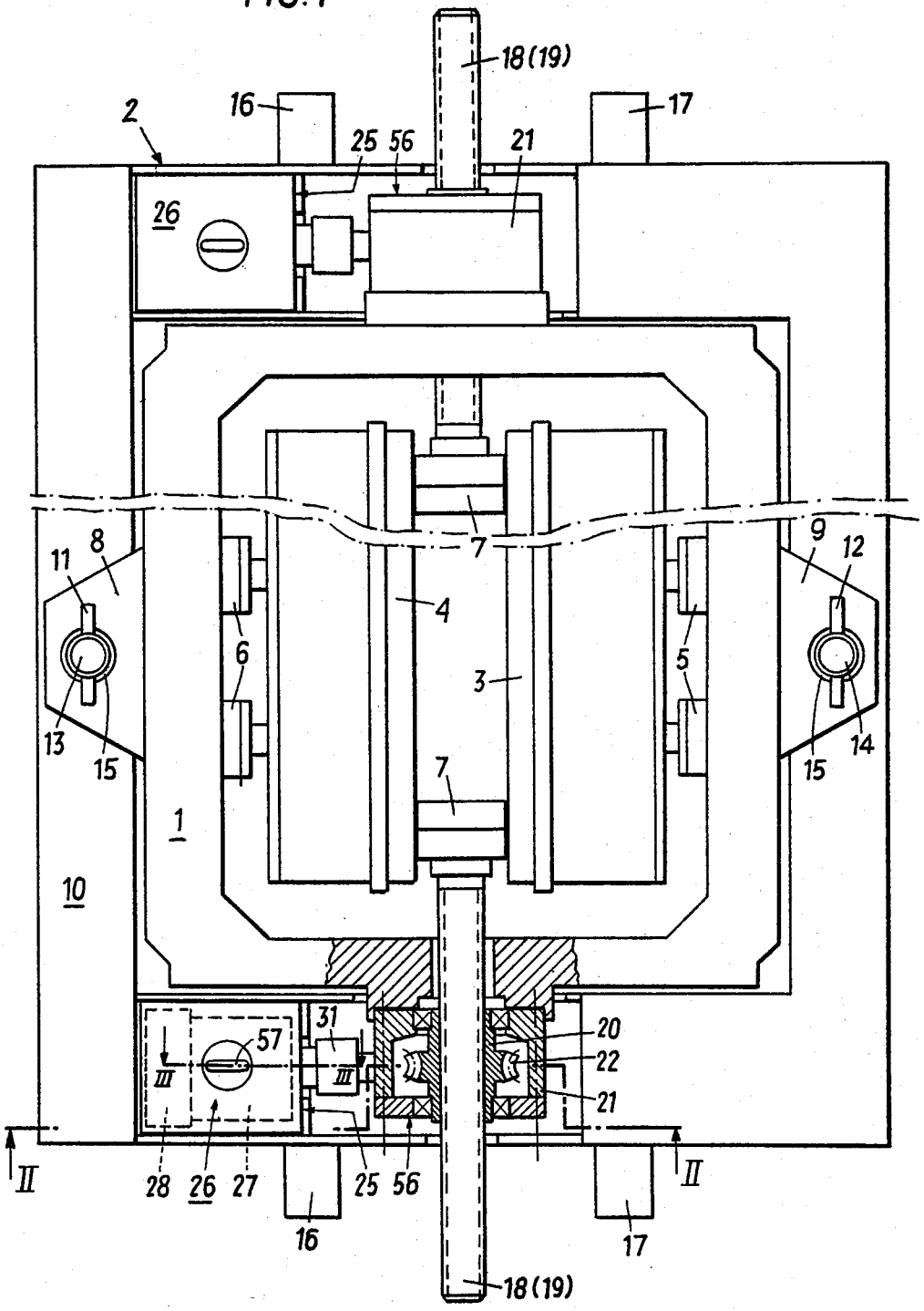
FIG. 1 is a partially sectioned top view of a mould.

In a carrying frame 1 of a mould 2, side walls 3 and 4 of a slab mould are arranged. These mould plates 3 and 4 are displaceable by hydraulic means 5 and 6. Between the mould side walls 3 and 4, end walls 7 are arranged. The carrying frame 1 of the mould, on its outer side, carries consoles 8, 9 by which it rests on the frame-like, vertically reciprocating lifting table 10. The carrying frame 1 is fastened to the lifting table with the help of wedges 11, 12 and vertical pins 13, 14 attached to the lifting table 10. The carrying frame 1 is displaceable and adjustable relative to the lifting table 10 by known means. In order to provide this adjustability, the pins 13 and 14 penetrate the consoles 8, 9 with a play 15.

On the outer sides of the lifting table 10, ledges 16, 17 are arranged, which coact with rollers (not illustrated) arranged on the structure of the continuous casting plant and serve to guide the reciprocating lifting table 10 in the continuous casting plant.

Threaded spindles 18, 19 are connected with each mould end wall 7 in a rotationally fast manner. These threaded spindles 18, 19 penetrate the carrying frame 1 and the lifting table 10. The threaded spindles 18 are each surrounded by a nut 20 mounted in a casing 21 flanged to the carrying frame 1 so as to be rotatable, but axially undisplaceable. The nut 20 is connected with a worm wheel 22. The worm wheel 22 is drivable by a worm 23 whose shaft 24 is rotatably and axially undisplaceably mounted in the casing 21.

The threaded spindles 18 and 19 are protected against contamination by suitable means, such as bellows, etc. (not illustrated). Also the gear casing 21 is sealed against the penetration of dirt and the emergence of oil.

On the lifting table 10 a vertical shaft 25 is provided into which a casing 26 may be inserted. This casing contains the adjustment drives for the mould end walls. Each adjustment drive comprises a motor 27, a spur gear 28, a driving shaft 29 and a coupling shaft 30. The coupling shaft 30 is connected with the worm shaft 24 via a coupling 31.

Figure 3:
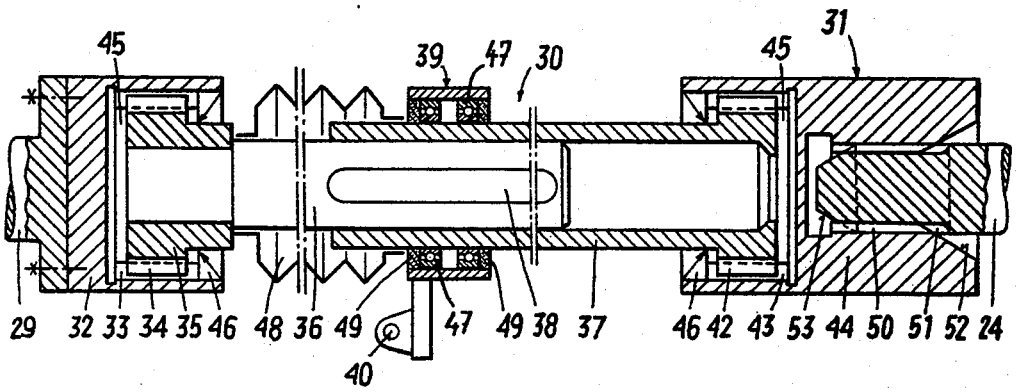
FIG. 3 shows a detail of FIG. 1 in a sectional view taken along the line III—III of FIG. 1 on an enlarged scale.
Figure 4:
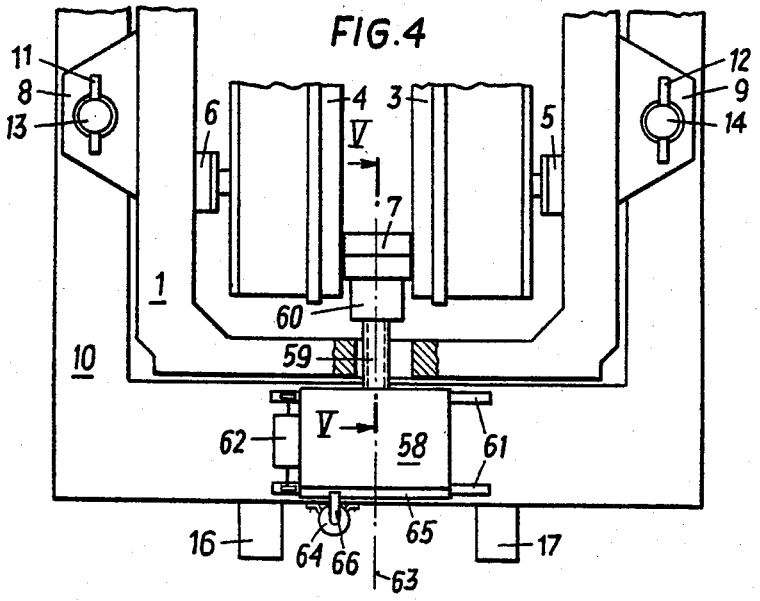
FIG. 4 is an illustration analogous to FIG. 1 of the second embodiment.
Figure 5:
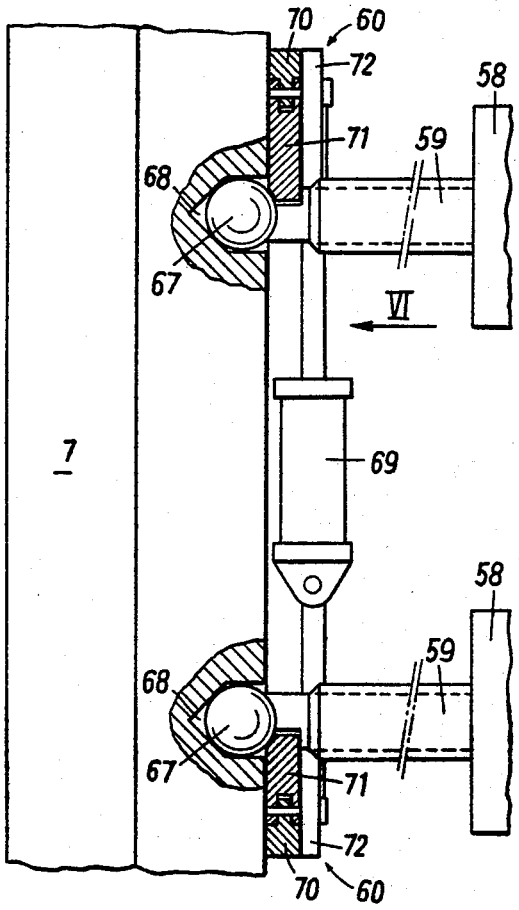
FIG. 5 is a sectional view taken along the line V—V of FIG. 4.
Figure 6:
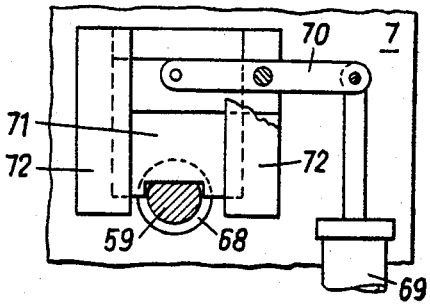
FIGS. 6 and 7 are views taken in the direction of arrow VI of FIG. 5 and arrow VII of FIG. 6, respectively.
Figure 7:
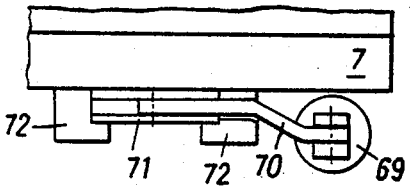
Figure 8:
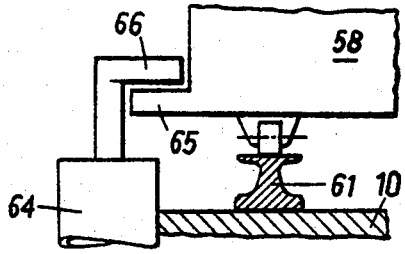
FIG. 8 illustrates a detail of the fixation of the adjustment drive.

The structure of the coupling shaft 30 can be taken from FIG. 3. The driving shaft 29 is connected with a coupling body 32. This coupling body is equipped with an internal toothing 33 in engagement with the external toothing 34 of a toothed pinion 35. The toothed pinion is connected with a shaft 36. This shaft is surrounded by a sleeve 37. A spring 38 prevents a rotation of the sleeve 37 relative to the shaft 36. The sleeve is axially displaceable relative to the shaft by a shift ring 39 mounted on the sleeve. The engagement and disengagement of the coupling is effected by a pressure medium cylinder 41 hinged to the eye 40 of the shift ring.

The sleeve 37, on its end, carries an external toothing 42. This external toothing 42 is in engagement with an internal toothing 43 of the coupling body 44. The toothings 33, 34 and 42, 43, are designed in a manner that slanted positions and displacements of the coupling bodies 32, 44 relative to the pinion 35 or the sleeve 37 are possible. The spaces 45 in which the toothings 42, 43 and 33, 34 are provided are filled with oil and closed with a seal 46. To protect the shaft 36 and the shift ring bearings 47, a folding bellow 48 and packing rings 49 are provided.

The coupling body 44 carries a further internal toothing 50 which is in engagement with an external toothing 51 at the end of the worm shaft 24. The coupling body 44 and the worm shaft 24 are each provided with a conical face 52, 53 in order to enable the engagement of the coupling 31. In the uncoupled state, a link plate 54 delimits the angular displacement of the coupling shaft 30.

In FIG. 3 the coupling 31 is illustrated in the coupled state. In this state, the piston rod 55 of the pressure medium cylinder 41 is completely moved out; the sleeve 37 is in its outermost right position (in FIG. 3). For the purpose of uncoupling the coupling 31, the piston rod 55 is retracted by actuation of the pressure medium cylinder 41, the sleeve 37 thus being moved to the left. Herein, the external toothing 51 of the worm shaft 24 and the internal toothing 50 of the coupling body 44 get out of engagement. After this disengagement of the couplings 31 and the removal of the wedges 11, 12, it is possible to lift the carrying frame 1 including the mould plates 3, 4, 7 and the adjustment gears 56 out of the lifting table 10 of the continuous casting plant. If it were necessary to carry out maintenance work at the adjustment drive, the casing 26 can be lifted out of the shaft 25 of the lifting table 10 with the help of a crane eyelet 57.

In the embodiment illustrated in FIGS. 4 to 8, not only the adjustment drive, but also the adjustment gear—both being united in a block and in the following denoted as adjustment means 58—are arranged on the lifting table 10, the adjustment spindles 59 being connected with the end walls 7 of the plate mould by means of a coupling 60. As can be seen from FIG. 4, the adjustment means 58 is movable on rails 61 transversely to the side walls 3, 4 of the mould. A motor 62 serves to displace this adjustment means 58 along the rails 61 in order to render feasible different cross sectional formats of the mould cavity, i.e., to utilize end walls 7 of different width. With different thicknesses of the strand, the central axis 63 of the mould end walls is changed, due to the mould side wall 4 being designed as a fixed side. By means of a pressure medium cylinder 64, the adjustment means 58 is fixable on the lifting table 10. The fixation is realized by the piston 66 of this pressure medium cylinder 64, holding down a flange 65 of the adjustment means 58.

The adjustment spindles 59 of the end walls comprise ball heads 67 self-centering in conical recesses 68 of the end walls 7. By means of a pressure medium cylinder 69, the ball heads 67 are pressable into the recesses 68 via coupling plates 71 by a two-arm lever 70 each, so that the adjustment spindles 59 are fixed without play on the end walls 7. This pressure medium cylinder 69 is double-acting. The coupling plates 71 are displaceably guided in grooves of guide ledges 72.

Figure 9:
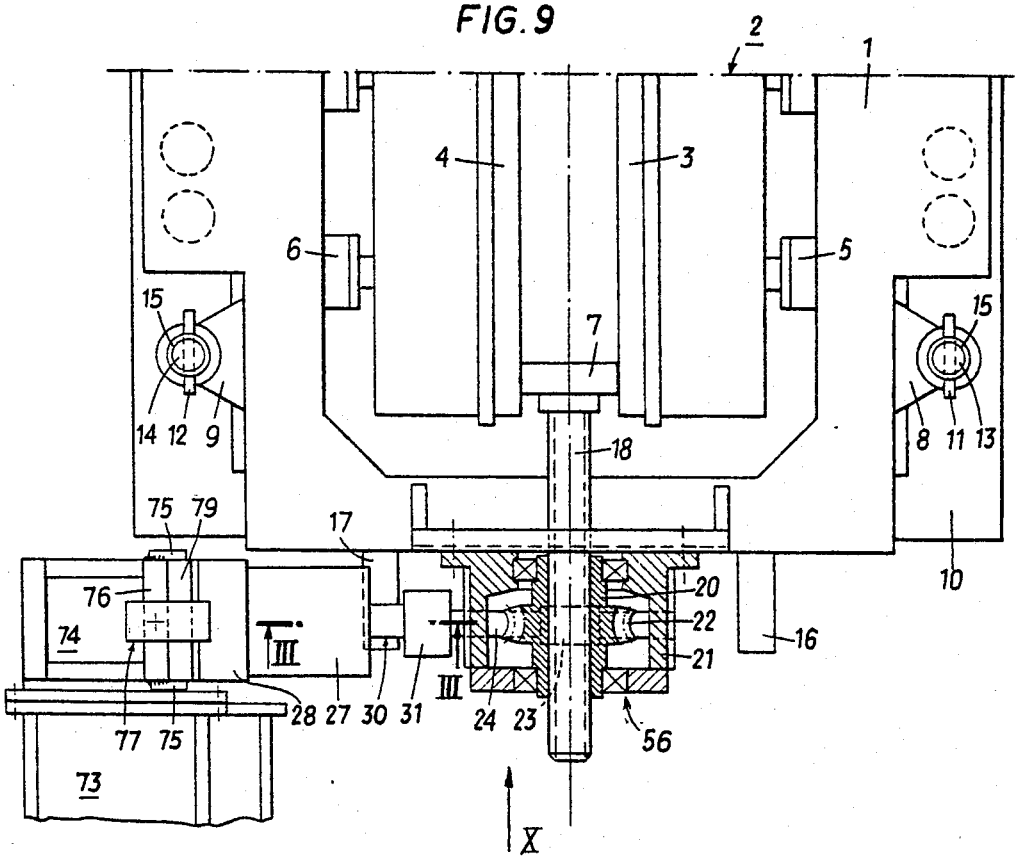
FIG. 9 is an illustration analogous to FIG. 1 of the third embodiment.
Figure 10:
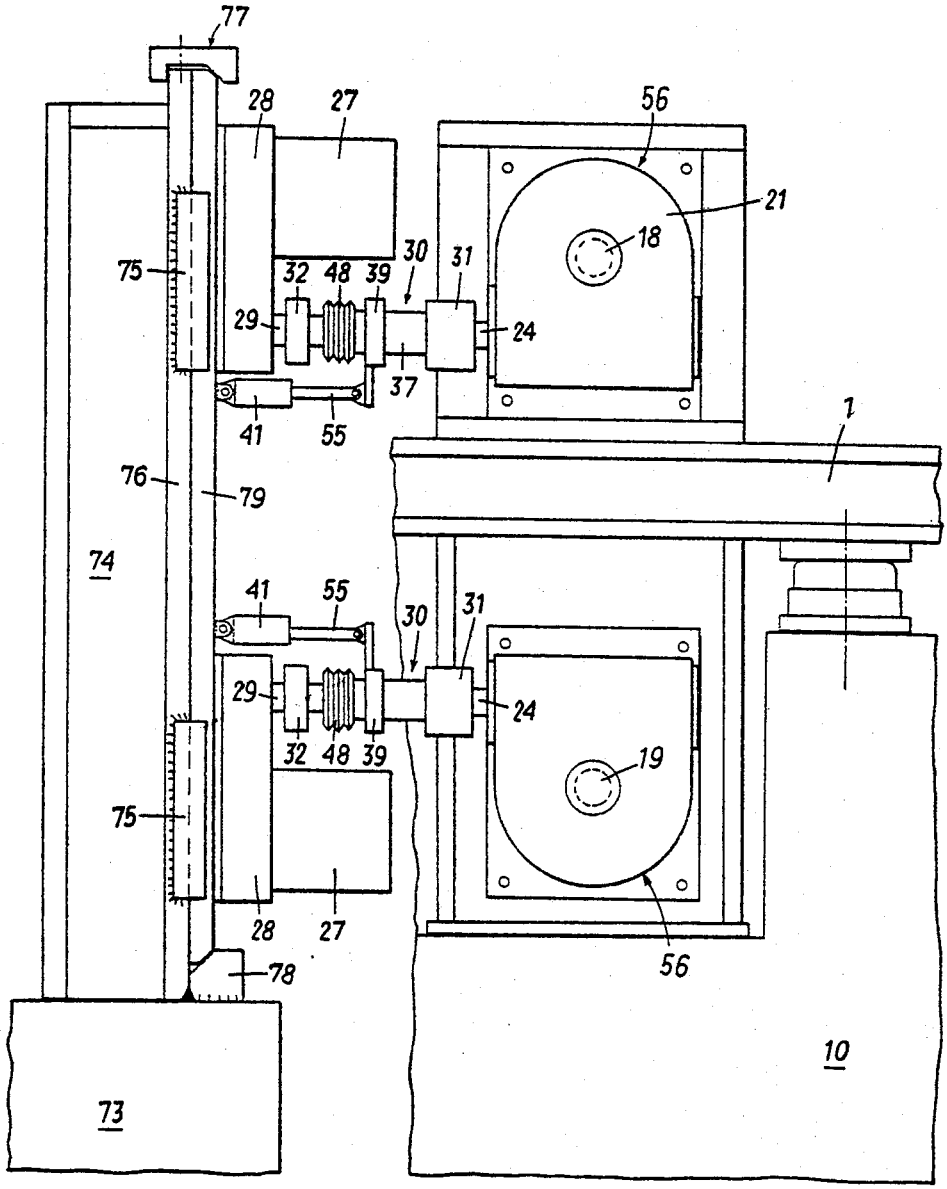
FIG. 10 is a view taken in the direction of the arrow X of FIG. 9.

The embodiment illustrated in FIGS. 9 and 10 illustrates a mould 1 with which the adjustment drive 27 is arranged on a stationary supporting structure 73 of the continuous casting plant, i.e., on a carrier of this supporting structure 73 which is in the close vicinity of the lifting table 10. For a detachable fastening of the adjustment drive 27, a flange plate 76 is provided on a fastening console 74 mounted on the supporting structure 73 and equipped with centering ledges 75, on which flange plate a counter flange plate 79 is fastenable by means of a bracket-like clamping means 77, 78, the motor 27 and the intermediate gear 28 of the adjustment drive being mounted to the counter flange plate. In this embodiment, parts that are designed analogously to the parts of the embodiment illustrated in FIGS. 1 to 3 have the same reference numerals.

The invention is not limited to the exemplary embodiments illustrated, but may be modified in various ways. It is, for instance, possible to provide vertical axes for the driving shafts of the embodiment of the adjustment drives and the worm shafts of the adjustment gears illustrated in FIGS. 1 to 3, so that the coupling procedure between the driving shaft of the adjustment drive and the worm shaft of the adjustment gear is effected merely by lowering the carrying frame plus the adjustment gear onto the lifting table.

Figure 2:
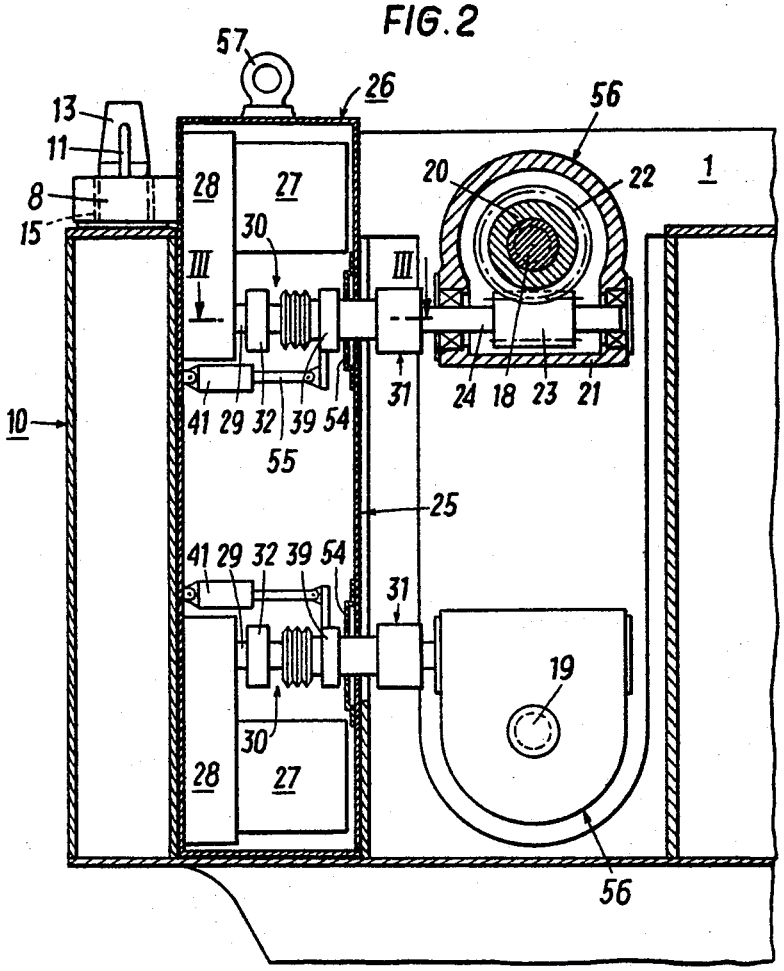
FIG. 2 is a sectional view taken along the line II—II of FIG. 1.

The coupling illustrated in FIGS. 1 to 3 may be replaced by a coupling of another design; thus, it is, for instance, possible to use a magnetic coupling. With the coupling shaft 30 provided in the embodiment of FIGS. 1 to 3, an articulation shaft advantageously could be provided, wherein an articulation need no longer be provided for by the couplings. All the adjustment gears of the mould may be driven also by a single driving motor.

With the embodiment illustrated in FIGS. 9 and 10 it is also possible to arrange on the stationary supporting structure 73 not only the adjustment drives 27, but also the adjustment gears 56.

What we claim is:

1. In a plate mould of a continuous casting plant, in partcular for continuously casting steel slabs, of the type including a reciprocating mould lifting table, a carrying frame mounted on said lifting table, a stationary supporting structure neighboring said lifting table, mould walls supported on said carrying frame and defining a mould cavity, and an adjustment means for displacing at least one of said mould walls transversely to the mould axis for changing the strand cross sectional format, the improvement wherein said adjustment means includes an adjustment drive mounted on said stationary supporting structure, and a coupling means for releasably connecting said adjustment drive with said at least one displaceable mould wall.

2. In a plate mould of a continuous casting plant, in particular for continuously casting steel slabs, of the type including a reciprocating mould lifting table, a carrying frame mounted on said lifting table, a stationary supporting structure neighboring said lifting table, mould walls supported on said carrying frame and defining a mould cavity, and an adjustment means for displacing at least one of said mould walls transversely to the mould axis for changing the strand cross sectional format, the improvement wherein said adjustment means includes an adjustment drive mounted on said lifting table, and a coupling means for releasably connecting said adjustment drive with said at least one displaceable mould wall.

3. A plate mould as set forth in claim 1 or 2, further comprising an adjustment gear driven by said adjustment drive.

4. A plate mould as set forth in claim 3, wherein said adjustment gear is arranged on said carrying frame and said coupling is provided between said adjustment gear and said adjustment drive.

5. A plate mould as set forth in claim 3, wherein said adjustment gear is arranged on said lifting table and said coupling is provided between said at least one displaceable mould wall and said adjustment gear.

6. A plate mould as set forth in claim 1, wherein said coupling is designed as a clutch coupling.

7. A plate mould as set forth in claim 2, wherein said coupling is designed as a clutch coupling.

8. A plate mould as set forth in claim 6 or 7, wherein said coupling allows for angular excursions.

9. A plate mould as set forth in claim 6 or 7, wherein said coupling is a jaw clutch coupling.

10. A plate mould as set forth in claim 1 or 2, wherein said adjustment drive comprises a driving shaft capable of being turned on and off by said coupling and designed as an articulation shaft.

11. A plate mould as set forth in claim 6 or 7, further comprising a connection shaft for connecting said adjustment drive and said adjustment gear, said connection shaft being adjustable in length.

12. A plate mould as set forth in claim 8, further comprising a connection shaft for connecting said adjustment drive and said adjustment gear, said connection shaft being adjustable in length.

13. A plate mould as set forth in claim 9, further comprising a connection shaft for connecting said adjustment drive and said adjustment gear, said connection shaft being adjustable in length.

14. A plate mould as set forth in claim 10, further comprising a connection shaft for connecting said adjustment drive and said adjustment gear, said connection shaft being adjustable in length.

15. A plate mould as set forth in claim 2, further comprising an adjustment gear driven by said adjustment drive, and wherein said coupling is provided between said at least one displaceable mould wall and said adjustment gear, said adjustment drive and said adjustment gear being displaceably mounted on said lifting table.

16. A plate mould as set forth in claim 2, further comprising an adjustment gear driven by said adjustment drive, and wherein said adjustment drive comprises a driving shaft capable of being turned on and off by said coupling and designed as an articulation shaft, said adjustment drive and said adjustment gear being displaceably mounted on said lifting table.

* * * * *